United States Patent [19]

Lopez

[11] Patent Number: 4,844,708

[45] Date of Patent: Jul. 4, 1989

[54] ELLIPTICAL-DRIVE OSCILLATING COMPRESSOR AND PUMP

[75] Inventor: Wallace Lopez, Albuquerque, N. Mex.

[73] Assignee: Astrl Corporation, Albuquerque, N. Mex.

[21] Appl. No.: 266,480

[22] Filed: Oct. 31, 1988

Related U.S. Application Data

[63] Continuation of Ser. No. 33,236, Apr. 2, 1987, abandoned.

[51] Int. Cl.[4] ..... F04C 9/00; F04C 21/00

[52] U.S. Cl. ..... 418/36

[58] Field of Search ..... 418/36

[56] References Cited

U.S. PATENT DOCUMENTS 3,112,062 11/1963 Way ..... 418/36
3,430,573 3/1969 Groeger ..... 418/36
3,565,049 2/1971 Bauer ..... 418/36
3,769,946 11/1973 Scherrer ..... 418/36
4,455,128 6/1984 Seybold ..... 418/36

*Primary Examiner*—John J. Vrablik
*Assistant Examiner*—Leonard P. Walnoha
*Attorney, Agent, or Firm*—Paul J. Cook

[57] ABSTRACT

A rotary apparatus uses vanes which oscillate with respect to one another, while simultaneously rotating within a chamber, to compress a gas or pump a liquid. The oscillating motion results from interaction of at least a single coupled pair of elliptical drive members. When the driver elliptical member is rotated at a constant angular velocity, it causes the driven elliptical member to rotate with a varying angular velocity. As the driven elliptical member is connected to at least one vane, that vane also rotates with a varying angular velocity. In a preferred embodiment, two pairs of meshing elliptical gears drive four vanes with an oscillating and rotating motion.

8 Claims, 4 Drawing Sheets

ELLIPTICAL-DRIVE OSCILLATING COMPRESSOR AND PUMP

This is a continuation of co-pending application Ser. No. 033,236 filed on Apr. 2, 1987, abandoned.

BACKGROUND OF THE INVENTION

The present invention relates to compressors and pumps, and more particularly to rotary devices having oscillating vanes.

Rotary compressors are commonly used as superchargers for internal combustion engines, in air conditioning systems and the like. Rotary pumps, such as water pumps, are also well known in the prior art. The most commonly encountered rotary compressors and pumps can be generally categorized as either centrifugal, axial, or radial. Rotary compressors and pumps generally have relatively few moving parts.

Another well known group of compressors and pumps operates by reciprocating motion. These devices usually have pistons moving within cylinders, a crank shaft and a valve train, and thus relatively many moving parts.

The present invention may be viewed as a hybrid of the traditional rotating and reciprocating devices, as it includes vanes which simultaneously rotate and oscillate within a chamber. The oscillating action alternately increases and decreases the size of fluid chambers, much like a reciprocating piston within a cylinder, yet the vanes also simultaneously rotate, somewhat like the motion in a radial vane compressor.

Devices which operate with simultaneously rotating and oscillating members are not, in themselves, new. One example is the rotary motor disclosed in U.S. Pat. No. 1,603,630 to Morris, in which rectangular pistons simultaneously rotate and oscillate within a cylinder. Another example is the rotary engine or pump disclosed in U.S. Pat. No. 4,068,985 to Baer, in which moveable walls simultaneously rotate and oscillate within a cylinder. In these patents, the motion is achieved through interaction of at least one sun gear and four planet gears. Each planet gear includes an eccentrically mounted crank which slides within a radial slot in the driven member. To operate as desired, each planet gear must be half the size of the sun gear.

The planetary gear trains of the prior art are disadvantageous as they include a large number of moving parts, are heavy and take up a relatively large amount of space. Furthermore, the sliding crank within the slot can be a significant source of friction and wear. Additionally, the gear trains of the prior art systems have relatively large rotating masses and require large horsepower inputs to overcome inertia when used as a compressor or pump.

It is, therefore, a principal object of the present invention to provide a light weight compressor and pump having a compact size.

Another principal object of the present invention is to provide a compressor and pump having few moving parts.

It is still another object to provide a pump and compressor having high efficiency.

A further object is to provide a compressor and pump having eight intake/exhaust cycles per full revolution.

Yet a further object is to provide a compressor and pump which can be operated and constructed relatively simply and economically.

SUMMARY OF THE INVENTION

The present invention relates to a compressor and pump in which at least a single coupled pair of elliptical drive members cause vanes to simultaneously oscillate with respect to one another, while rotating within a chamber. Each coupled pair of elliptical drive members includes a driver member and a driven member. When the drive member is rotated at a constant angular velocity, the elliptical shape of the coupled members causes the driven member to rotate with a varying angular velocity.

The invention includes a chamber having a circular cross-section, and at least two vane members within the chamber which rotate independently of each other. Each vane member includes at least one vane extending from the center of the chamber to its periphery. Thus, the chamber is divided into two or more volumes.

Each driven elliptical member is connected to a vane member, which therefore, also rotates with a varying angular velocity. The elliptically driven vane member oscillates with respect to the other vane member as both rotate within the chamber, and the volume within the chamber alternately increase and decrease. Fluid is taken into the increasing volume, and exhausted out of the decreasing volume.

In a preferred embodiment, the invention includes two pairs of meshing elliptical gears driving two vane members, each of which has two vanes. All four elliptical gears have the same size and shape, and the two driver elliptical gears are out of phase by 90°. The driver gears are connected together and rotate with the same constant angular velocity. The driven gears, and thus the vane members each rotate with varying angular velocities.

The chamber preferably has a cylindrical shape, and each vane member is bow-shaped, with two opposed wedge-shaped vanes. The vane members and driven elliptical gears all rotate coaxially on a common fixed shaft. Each driven gear is connected to its respective vane member through a pair of drive pins which are radially separated from the drive shaft. Each pair of pins passes through holes in a rotating seal, which forms part of an end wall of the chamber. The drive pins connecting one driven gear to its vane member pass through slots in the other driven gear.

The operation and general configuration of the present invention is the same whether it is embodied as an air compressor or a water pump. The major differences are in the size and strength of the components in the water pump in light of the greater forces and pressures encountered.

These and other features and objects of the present invention will be described in the following detailed description of the invention which should be read in light of the accompanying drawings.

DETAILED DESCRIPTION OF THE PREFERRED EMBODIMENTS

Figure 1:
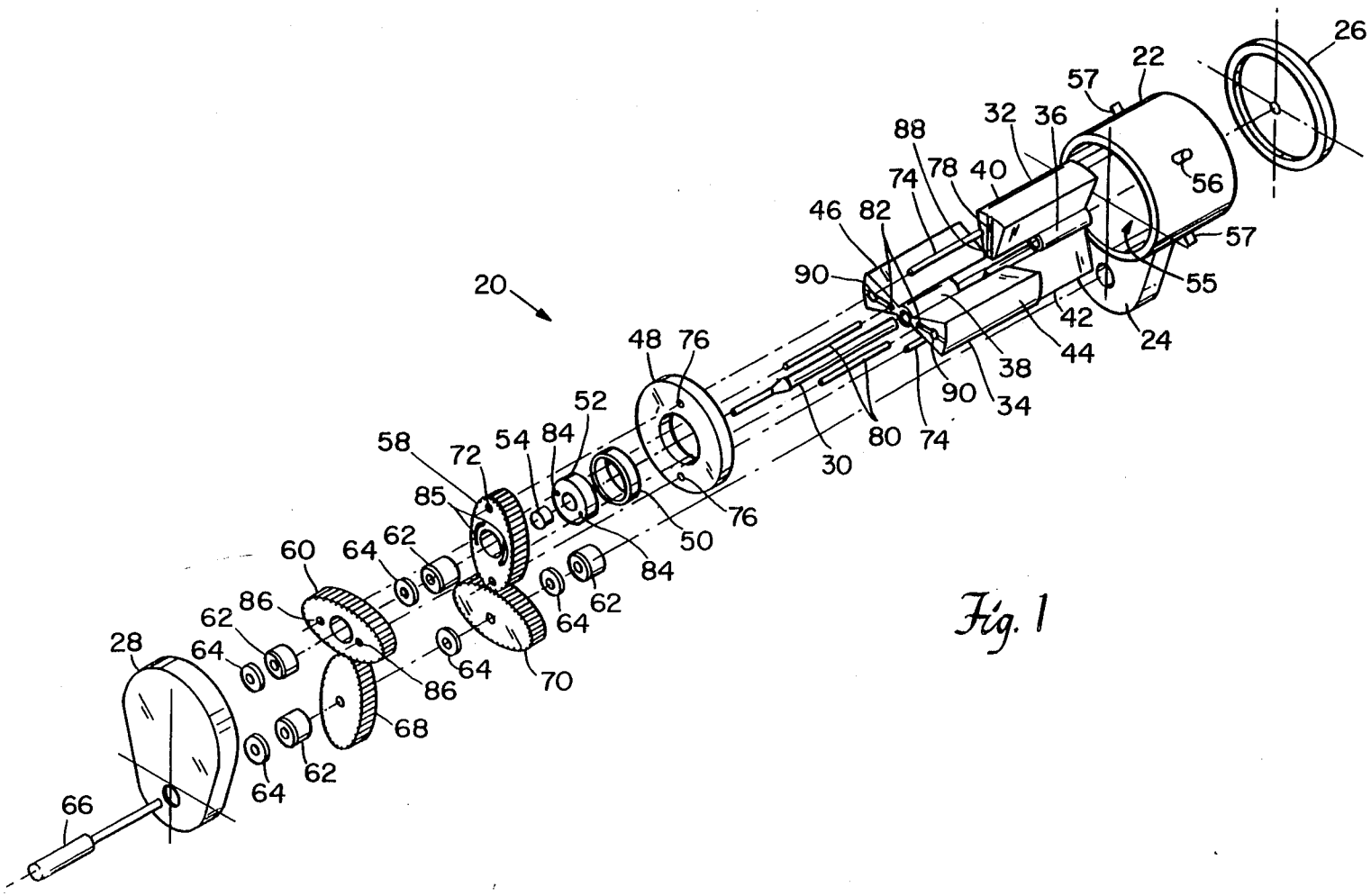
FIG. 1 is an exploded perspective view of a preferred embodiment of a compressor to be assembled in accordance with the present invention.

Referring to FIG. 1, there is an elliptical-drive oscillating compressor 20 shown in exploded view. Dashed lines indicate assembly of the components of the compressor 20. The compressor 20 has a generally cylindrical housing 22 having a lower flange 24. An end cap 26 attaches to the rear of the housing 22, and a front cap 28 attaches to the front.

A main shaft 30 is fixed along the central axis of the housing 22. One end of the shaft 30 is attached to the center of the end cap 26, and the opposite end of the shaft 30 is attached to the front cap 28. The main shaft 30 is preferably non-rotatable. A bow-shaped rear vane member 32 and a bow-shaped front vane member 34 each rotate about the shaft 30 within the housing 22.

Each vane member 32, 34 includes a central hub 36, 38 which extends axially only part way along the shaft 30. As can be clearly seen, vane member 32 is oriented so that hub 36 is toward the rear of the shaft 30, and vane member 34 is oriented so that hub 38 is toward the front of the shaft. In this way, each vane member 32, 34 can rotate about the shaft 30 independently. Vane member 32 includes opposing wedge-shaped vanes 40 and 42, and vane member 34 includes wedge-shaped vanes 44 and 46.

The angle between vanes 40 and 42 is fixed at 180°. Similarly, the angle between vanes 44 and 46 is also fixed at 180°. The angle between adjacent vanes, for example between vanes 42 and 44, however, varies as vane members 32 and 34 oscillate with respect to each other about the shaft 30 as will be discussed below. It should be noted that, each of the foregoing angles is measured from the midplane, rather than a face, of each vane.

The main shaft 30 passes through the center of a rotating inner seal 52, a journal bearing 50, a rotating outer seal 48 and a journal bearing seal 54. The outer seal 48 together with the bearing 50 the inner seal 52 and the bearing seal 54, form a front end of a cylindrical chamber 55 within the housing 22. A pair of first ports 56, located on opposite sides of the housing 22, provide fluid flow paths into the chamber 55. A pair of second ports 57, located on opposite sides of the housing 22 from each other, and preferably 90° from the ports 56, also provide fluid flow paths into the chamber. The angle of the parts 56 to the ports 57 may vary depending on the desired pressure boost.

The main shaft 30 also passes through a rear driven elliptical gear 58, a front driven elliptical gear 60, a pair of roller bearings 62 and a pair of thrust washers 64. A splined drive shaft 66 passes through the front cap 28, and also through a front driver elliptical gear 68, a rear driver elliptical gear 70, three thrust washers 64 and a pair of roller bearings 62. The gears 58, 60, 68 and 70 all have the same size and shape.

The drive shaft 66 is connected to a remote source of torque (not shown) which rotates the drive shaft. The driver elliptical gears 68 and 70 have major axes which are offset 90° from each other, and are fixed to the splined drive shaft 66. Thus, the gears 68 and 70 turn with the shaft 66, and at all times remain perpendicular to each other. The teeth of the front driver gear 68 mesh with the teeth of the front driven elliptical gear 60. One of the roller bearings 62 fits within the driven gear 60, permitting it to freely rotate about the main shaft 30. Similarly, the teeth on rear driver gear 70 mesh with the teeth on rear driven elliptical gear 58. Another roller bearing 62 within the driven gear 58 permits it to freely rotate about the main shaft 30.

When the drive shaft 66 is rotated at a constant angular velocity by the remote source of torque, the driver gears 68 and 70 are rotated at the same angular velocity, and the driven gears 58 and 60 are rotated at varying angular velocities. As will be more fully discussed below, the variation in angular velocity of the driven gears 58 and 60 is a function of the shape of the elliptical gears. Thus, while driver gears 68 and 70 remain perpendicular to each other, the angle between driven gears 58 and 60 varies as the gears rotate.

The rear driven elliptical gear 58 includes a pair of holes 72 located near its edge along its maximum diameter (major axis). A pair of drive pins 74 connect the rear driven gear 58 to the rear vane member 32. The drive pins 74 pass through a pair of holes 76 in the rotating outer seal 48, and into outer holes 78 in the rear vane member 32. The journal bearing 50 and rotating inner seal 52 are small enough to avoid interference with the pins 74.

Another pair of drive pins 80 connect the front driven gear 60 to the front vane member 34. The drive pins 80 pass from inner holes 82 in the vane member 34, through a pair of holes 84 in the rotating inner seal 52, through a pair of slots 85 in the gears 58, and into holes 86 in the driven gear 60.

As shown, a pair of inner holes 88 in vane member 32 and a pair of outer holes 90 in vane member 34 are not used. Preferably, the vane members 32 and 34, are manufactured to be interchangeable, and thus have both inner and outer holes.

When the shaft 66 is rotated, the front driver gear 68 rotates with the shaft causing the driven gear 60 to rotate. The front vane member 34 and the rotating inner seal 52 rotate with the driven gear 60. In a similar manner, the rear vane member 32 and rotating outer seal 48 both rotate with the rear driven gear 58 when it is caused to rotate by the rear driver gear 70.

In operation, when the shaft 66 is rotated at constant angular velocity, the elliptical gears 58, 60, 68 and 70 cause the vanes 40, 42 and 46 to have a varying angular velocity. Thus, the vane simultaneously rotate within the housing 22 about the shaft 30, while adjacent vanes oscillate with respect to each other. This simultaneous rotation and oscillation causes volumes of space between the vanes within the housing 22 to vary as can be most clearly seen from FIGS. 2A–2E. Corresponding components in FIGS. 1 and 2A–2E are identified herein with the same reference numerals, but with primes added for components shown in FIGS. 2A–2E which have a different configuration from those in FIG. 1.

A front driver elliptical gear 68′ engages a front driven elliptical gear 60′. A rear driver elliptical gear 70′, located behind front driver gear 68′, engages rear driven elliptical gear 58′, which in turn is located behind front driven gear 60′. Note that the elliptical gears 58′, 60′, 68′ and 70′ all fit within a housing 22′ as they are somewhat smaller than the corresponding gears in FIG. 1. Lines 58*a*, 60*a*, 68*a* and 70*a* indicate the maximum diameter (major axis) of each gear. Additionally, it should be noted that gear teeth have only been indicated in the area where the teeth mesh, whereas, for the sake of clarity, the remainder of each gear is represented by its pitch surface.

A generally wedge-shaped volume A is defined by the vanes 40 and 44 and the housing 22'. Similarly, a volume B lies between vanes 40 and 46, a volume C lies between vanes 42 and 46 and a volume D lies between vanes 42 and 44. Since vanes 40 and 42 are 180° apart, and vanes 44 and 46 are also 180° apart, volumes A and C are always equal to each other, and volumes B and D are also always equal.

Figure 2A:
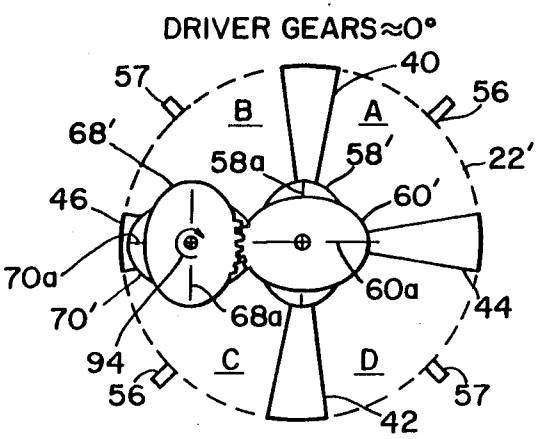
FIGS. 2A–2E are schematic representations of an initial position and four subsequent positions during one quarter revolution of a preferred embodiment of a compressor constructed in accordance with the present invention.
Figure 2B:
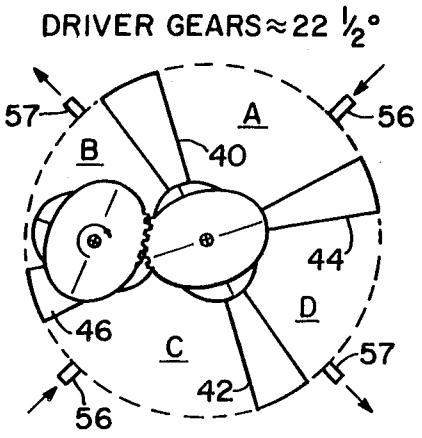
Figure 2C:
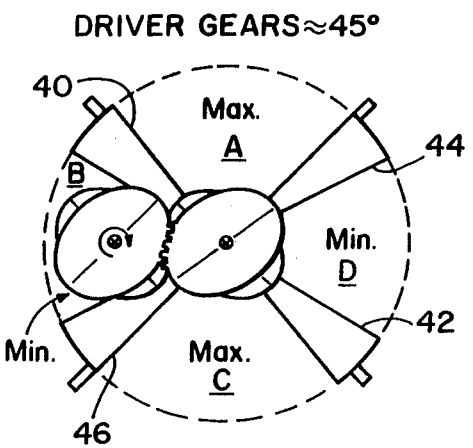
Figure 2D:
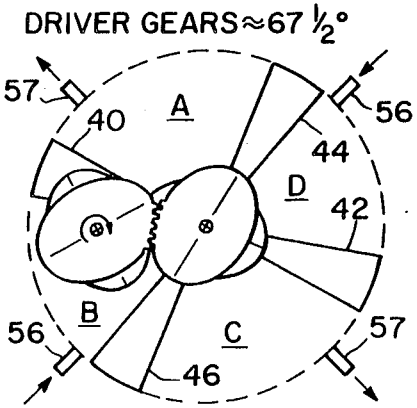
Figure 2E:
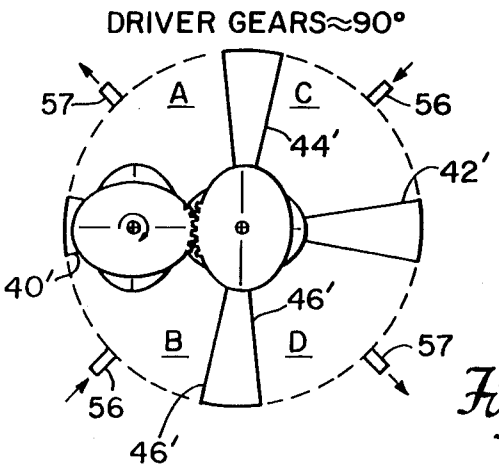

A circular arrow 94 indicates the direction of rotation of the driver gears 68' and 70'. FIGS. 2A–2E depict the positions of the gears and vanes initially and after four successive rotations of the driver gears of approximately 22½° each. Thus, FIG. 2E depicts the relative positions of gears and vanes after one quarter revolution of the driver gears from the positions depicted in FIG. 2A.

Note that while the driver gears 68' and 70' remain always perpendicular to each other, the angle between the driven gears 58' and 60' varies as a function of the angular rotation of the driver gears. Thus, the volumes A and C increase and reach a maximum after a rotation of approximately 45° as shown in FIG. 2C, and the volumes B and D decrease, reaching a minimum also after the driver gears have rotated approximately 45°. Rotating the driver gears further would cause volumes A and C to decrease to a minimum at approximately 135°, while simultaneously increasing volumes B and D to a maximum also at approximately 135° (not shown).

To operate the present invention as a compressor, a gaseous fluid such as air is supplied to the first ports 56 and is drawn into the expanding volumes A and C, and then exhausted through the second ports 57 from contracting volumes B and D. From the series of FIGS. 2A–2E, it is thus clear that one quarter revolution results in two intake/exhaust cycles, and that a full revolution would result in eight cycles.

The elliptical gears 58', 60', 68' and 70' all have a relatively small eccentricity. As a result, there is a relatively small variation between the maximum and minimum volumes shown in FIG. 2C. At the limit, use of circular gears which have an eccentricity of 0.0 would result in no variation in volumes. In an apparatus constructed in accordance with the present invention, use of elliptical gears having a larger eccentricity would result in larger differences between the maximum and minimum volumes, and therefore, larger compression ratios. Of course, it is difficult to manufacture elliptical gears that will reliably mesh having too large an eccentricity.

Figure 3A:
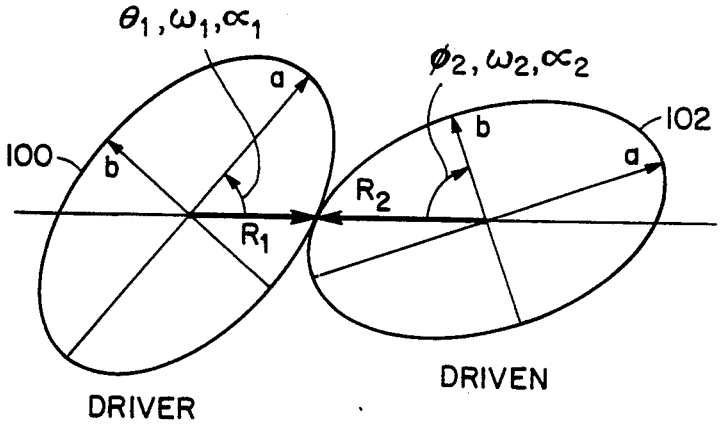
FIGS. 3A and 3B are graphical constructions of pairs of rolling ellipses which are useful in understanding the present invention.
Figure 3B:
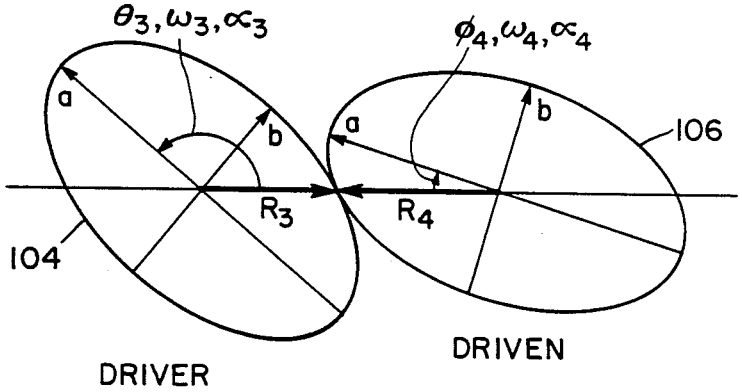

The effect of the eccentricity of the elliptical gears on variations in angular velocity of the vanes will be best understood with reference to FIGS. 3A and 3B.

FIG. 3A represents a first pair of driver and driven gears, 100 and 102 respectively, depicted here as rolling ellipses, at an arbitrary angle of rotation. FIG. 3B represents a second pair of driver and driven gears, 104 and 106 respectively, at the same arbitrary angle of rotation. All four gears are the same size and shape. Note that driver gears 100 and 104 are perpendicular, and that driven gears 102 and 106 are not.

In terms of polar coordinates, R, $\theta$, the general equation for an ellipse is given in the text *Mechanisms, Linkages and Mechanical Controls* (McGraw-Hill, 1965), and may be written:

$$R = \frac{2ab}{a + b - (a - b)\cos 2\theta} \tag{1}$$

Where, a=maximum radius (along major axis), b=minimum radius (along minor axis), R=radius to a point along the ellipse, and $\theta$=the angle measured from the major axis to the point.

Alternatively, the general equation for an ellipse may be written:

$$R = \frac{2ab}{a + b + (a - b)\cos 2\phi} \tag{2}$$

Where, $\theta$=the angle measured from the minor axis to the point.

Note that:

$$\phi = \frac{\pi}{2} - \theta \tag{3}$$

Equations for the gears 100 and 102 may therefore be written:

$$R_1 = \frac{2ab}{a + b - (a - b)\cos 2\theta_1} \tag{4}$$

and, $$R_2 = \frac{2ab}{a + b + (a - b)\cos 2\phi_2} \tag{5}$$

where the variables a, b, $R_1$, $\theta_1$, $R_2$ and $\phi_2$ are as defined above, with the subscript 1 referring to gear 100, and the subscript 2 referring to gear 102, and with the further limitation that $R_1$, $R_2$, $\theta_1$ and $\phi_2$ are radii and angles, respectively, to the point of contact between the gears 100 and 102, as shown in FIG. 3A.

Similarly, equations for the gears 104 and 106 may be written:

$$R_3 = \frac{2ab}{a + b - (a - b)\cos 2\theta_3} \tag{6}$$

and, $$R_4 = \frac{2ab}{a + b + (a - b)\cos 2\phi_4} \tag{7}$$

where the subscript 3 refers to gear 104, and the subscript 4 refers to gear 106, and $R_3$, $R_4$ $\theta_3$ and $\phi_4$ are radii and angles to the point of contact between the gears 104 and 106, as shown in FIG. 3B.

From equations (6) and (7) the angles $\phi_2$ and $\phi_4$ of driven gears 102 and 106 may be expressed:

$$\phi_2 = \tfrac{1}{2}\cos^{-1}\left[\frac{2ab - R_2(a + b)}{R_2(a - b)}\right] \tag{8}$$

and, $$\phi_4 = \tfrac{1}{2}\cos^{-1}\left[\frac{2ab - R_4(a + b)}{R_4(a - b)}\right] \tag{9}$$

Since the distance between the centers of the gears is a+b and remains constant and $R_1$, $R_2$, $R_3$ and $R_4$ are all radii to the contact points:

$$R_2 = a + b - R_1 \tag{10}$$

and, $$R_4 = a + b - R_3 \tag{11}$$

Combining equations (4), (8) and (10), the angle $\phi_2$ of driven gear 102 may be expressed in terms of a, b and $\theta_1$ as:

$$\phi_2 = \tfrac{1}{2}\cos^{-1}\left[\frac{b^2 - a^2 + (a^2 + b^2)\cos 2\theta_1}{a^2 + b^2 + (b^2 - a^2)\cos 2\theta_1}\right] \tag{12}$$

and the angle $\phi_4$ of driven gear 106 may be expressed in terms of a, b and $\theta_3$ as:

$$\phi_4 = \tfrac{1}{2}\cos^{-1}\left[\frac{b^2 - a^2 + (a^2 + b^2)\cos 2\theta_3}{a^2 + b^2 + (b^2 - a^2)\cos 2\theta_3}\right] \tag{13}$$

For elliptical gears, the relationship between driver gear angular velocity and driven gear angular velocity is given by the text *Mechanisms, Linkages, and Mechanical Controls* (McGraw-Hill, 1965) as:

$$w_o = w_i \frac{b^2 + a^2 + (b^2 - a^2)\cos 2\phi_o}{2ab} \tag{14}$$

where, $w_o$=angular velocity of the driven (output) gear,
$w_i$=angular velocity of the driver (input) gear, and
$\phi_o$=angle of the driven (output) gear to the contact point measured from the minor axis.

Therefore, the angular velocity relationship between the gears 100 and 102 may be written:

$$w_2 = w_1 \frac{b^2 + a^2 + (b^2 - a^2)\cos 2\phi_2}{2ab} \tag{15}$$

where, $w_1$=angular velocity of the driver gear 100, and
$w_2$=angular velocity of the driven gear 102.

Similarly, the angular velocity relationship between the gears 104 and 106 may be written:

$$w_4 = w_3 \frac{b^2 + a^2 + (B^2 - a^2)\cos 2\phi_4}{2ab} \tag{16}$$

where, $w_3$=angular velocity of driver gear 104, and
$w_4$=angular velocity of driven gear 106.

In order to fully characterize the motion of the elliptical gears, the angular acceleration relationship between the gears 100 and 102, has been found by taking the time derivative of equation (15), and is expressed as:

$$\alpha_2 = \frac{\alpha_1(b^2 + a^2 + (b^2 - a^2)\cos 2\phi_2) - 2w_1w_2\,(b^2 - a^2)\sin 2\phi_2)}{2ab} \tag{17}$$

where, $\alpha_1$=angular acceleration of driver gear 100, and
$\alpha_2$=angular acceleration of driven gear 102.

Similarly, the angular acceleration relationship between the gears 104 and 106 is:

$$\alpha_4 = \frac{\alpha_3(b^2 + a^2 + (b^2 - a^2)\cos 2\phi_4) - 2w_3w_4\,(b^2 - a^2\sin 2\phi_4)}{2ab} \tag{18}$$

where, $\alpha_3$=angular acceleration of driver gear 104, and
$\alpha_4$=angular acceleration of driven gear 106.

Figure 4:
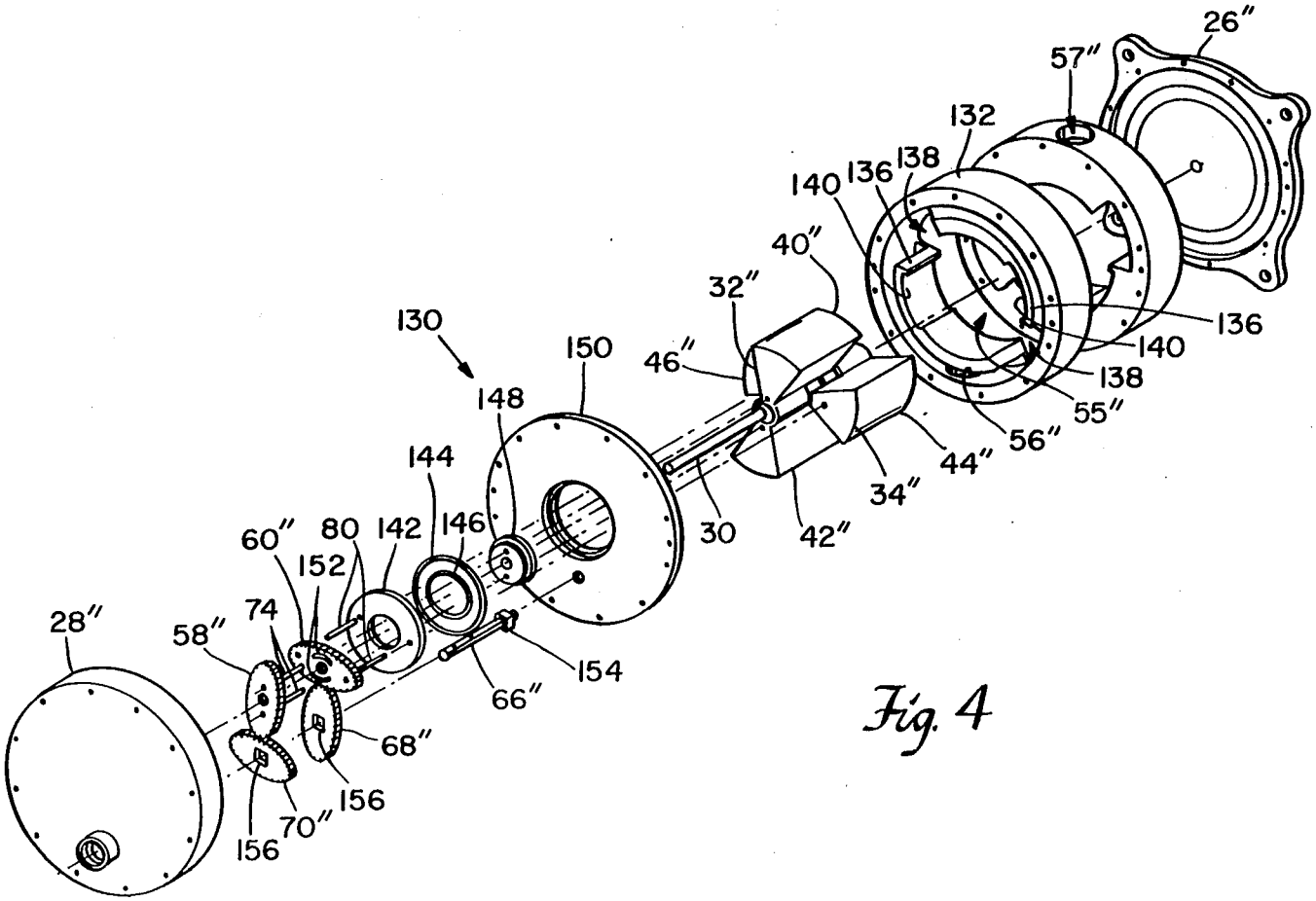
FIG. 4 is an exploded perspective view of a preferred embodiment of a pump to be assembled in accordance with the present invention.

Referring now to FIG. 4, an elliptical drive oscillating pump 130 operates in a manner similar to the compressor 20. Corresponding components in the pump 130 and the compressor 20 are identified herein with the same reference numerals, but with double primes added for components of the pump 130 which have a different configuration from those of the compressor 20.

A pair of vane members 32″ and 34″ of the pump 130 are larger than the corresponding vane members of the compressor 20 in light of the greater forces involved in pumping a liquid such as water when compared to compressing a gas such as air. Similarly, an end cap 26″ and a front cap 28″ are thicker than corresponding compressor components. A housing intake member 132 and a housing discharge member 134 combine to take the place of the housing 22 of the compressor 20. The housing intake member 132 includes a single intake port 56″, and the housing discharge member 134 includes a single discharge port 57″. The housing intake member 132 includes a pair of internal circumferential flanges 136. The flanges 136 do not extend all the way around the intake member 132, and the gaps between the flanges 136 form a pair of fluid flow passages 138. The flow passages 138 are analogous to the intake ports 56 in the compressor 20. Additionally, each flange 136 has an area of reduced thickness forming a trough 140.

In operation, a liquid such as water flows into the intake port 56″ and flows within the housing intake member 132 between the outer wall of the member 132 and the internal circumferential flanges 136. The liquid then flows through the flow passages 138 into a chamber 55″. As the liquid is pumped, it flows into the trough 140, and then into and out of the housing discharge member 134 via the discharge port 57″. The discharge member 134 includes internal flanges similar to the flanges 136, but which are concealed from view due to the orientation of the housing discharge member 134 in this perspective figure.

In a manner similar to the construction of the compressor 20, a driven gear 60″ is connected to the vane member 34″ through the pair of drive pins 80. THe drive pins 80 pass through a pair of holes in an outer rotating seal 142, through the annular gap between an outer seal ring 144 and an inner seal ring 146, past an inner rotating seal 148, through the central opening in a fixed seal 150 and into the vane member 34″. vane member 32″? The drive pins 74 pass within a pair of slots 152 in the gear 60″, and into the vane member 32.

A drive shaft 66″ is supported by the fixed seal 150, and passes through a pair of driver gears 68″ and 70″ and then through the front cap 28″. The drive shaft 66″ includes a square key 154 which fits within square keyways in the driver gears 68″ and 70″. Use of the key 154 and keyways 156 insures that the driver gears 68″ and 70″ remain perpendicular to each other.

It is thus seen that the objects of this invention have been achieved and other advantageous results attained in that there has been disclosed an elliptical drive oscillating compressor and pump which is compact and lightweight, which has few moving parts, which has high efficiency, which has eight cycles per revolution, which is dynamically balanced, and which is relatively simple and economical to operate and construct.

While FIGS. 1 and 4 show a compressor and pump having substantially cylindrical shapes, it is to be understood that such structure is not intended as any limitation, as the present invention might have a spherical or other shape. Furthermore, while FIGS. 1 and 4 show a compressor and pump having two pairs of coupled elliptical drive members, causing both vane members to rotate with varying angular velocities, it would also be possible for an apparatus to be constructed with a single pair of elliptical gears. The elliptical gears would cause one of the vane members to rotate with a varying angular velocity, while the other vane member rotates with a constant angular velocity. As the compressing or pumping action results from the oscillation of the vanes with respect to each other as they rotate, the single pair of elliptical gears would produce the required oscillation.

Various modifications of the present invention will become apparent to those skilled in the art from the foregoing description and accompanying drawings. For example, a pair of vane members each having three or more evenly distributed vanes might be used. For an apparatus with six vanes, there would be twelve complete intake/exhaust cycles per revolution. Additionally, while the invention has been described as including pairs of elliptical members coupled together by meshing gear teeth, it would also be possible to couple the members in other ways. Such modifications are intended to fall within the scope of the appended claims.

What is claimed is:

1. Apparatus for taking in and exhausting a fluid comprising:

a fluid chamber having a substantially circular cross-section, a first rotatable member within said fluid chamber having at least two vanes extending from the center of said fluid chamber to its periphery, said vanes being located at substantially even angular intervals, a second rotatable member within said fluid chamber having at least one vane extending from the center of said chamber to its periphery, means for exhausting a fluid from said fluid chamber, a first gear drive member having a substantially elliptical shape, means for connecting said first drive member to said first rotatable member including at least two first drive pins radially separated from the center of said fluid chamber, a first rotatable seal located between said first drive member and said first rotatable member, whereby said first drive pins pass through said first rotatable seal, a second gear drive member having a substantially elliptical shape means for connecting said second drive member to said second rotatable member including at least two second drive pins radially separated from the center of said fluid chamber, a third gear drive member having a substantially elliptical shape intermeshing with said third gear drive member, a fourth gear drive member having a substantially elliptical shape intermeshing with said second gear drive member, means for rotating said third and fourth gear drive members thereby to rotate said first and second gear drive members, to rotate said first and second rotatable members and to cause said first and second rotatable members to oscillate relative to each other.

2. The apparatus of claim 1 wherein:

said second rotatable member includes at least two vanes extending from the center of said fluid chamber to its periphery, and said second rotatable member rotating means includes a third drive member, and further comprising at least two second drive pins radially separated from the center of said fluid chamber connecting said third drive member to said second rotatable member, and a second rotatable seal located between said third drive member and said second rotatable member, whereby said second drive pins pass through said second rotatable seal.

3. The apparatus of claim 2 wherein said second drive pins pass through slots in said first drive member.

4. The apparatus of claim 1 wherein said first, second, third and fourth drive members all have substantially the same size and shape.

5. The apparatus of claim 1 wherein the major axis of said fourth drive member is held substantially perpendicular to the major axis of said third drive member as said third drive member rotates.

6. The apparatus of claim 1 wherein each said vane is substantially wedge-shaped.

7. The apparatus of claim 1 wherein said second rotatable member includes at least two vanes extending from the center of said fluid chamber to its periphery, said vanes being located at substantially even angular intervals.

8. The apparatus of claim 1 wherein said fluid taking in means includes at least two ports located at substantially even angular intervals.

* * * * *